United States Patent [19]

Hamblin

[11] Patent Number: 4,811,444

[45] Date of Patent: Mar. 14, 1989

[54] DOUBLE-SIDED ADHESIVE CLEANING APPARATUS

[76] Inventor: Charles R. Hamblin, 6021 Flintridge Dr., Colorado Springs, Colo. 80918

[21] Appl. No.: 206,395

[22] Filed: Jun. 14, 1988

[51] Int. Cl.[4] ..... A47L 25/00

[52] U.S. Cl. ..... 15/104 A; 15/227

[58] Field of Search ..... 15/104 A, 227

[56] References Cited

U.S. PATENT DOCUMENTS

| | | | |
|---|---|---|---|
| 3,056,154 | 10/1962 | Neal | 15/104 A |
| 3,231,918 | 2/1966 | Marks | 15/104 |
| 3,362,775 | 1/1968 | Maecke | 15/227 X |
| 3,389,416 | 6/1968 | Timms | 15/104 |
| 3,417,418 | 12/1968 | Riboud | 15/104 |
| 3,460,182 | 8/1969 | Grande | 15/227 |
| 3,680,170 | 8/1972 | Sims | 15/227 |
| 3,906,578 | 9/1975 | Huber | 15/104 A |
| 4,697,295 | 10/1987 | Garrison | 15/227 |

*Primary Examiner*—Chris K. Moore

*Attorney, Agent, or Firm*—Henderson & Sturm

[57] ABSTRACT

A double-sided adhesive cleaning apparatus (10) to be worn on the sole (51) of a shoe (50to pick up debris from the surface of a floor (100); wherein the apparatus (10) includes an elongated adhesive strip member (13) having upper (14) and lower (15) adhesive coated surfaces; wherein, the upper adhesive coated surface (14) attaches to the sole (51) of a users shoe (50) and the lower adhesive coated surface (15) accumulates debris.

4 Claims, 1 Drawing Sheet

FIG. 1.
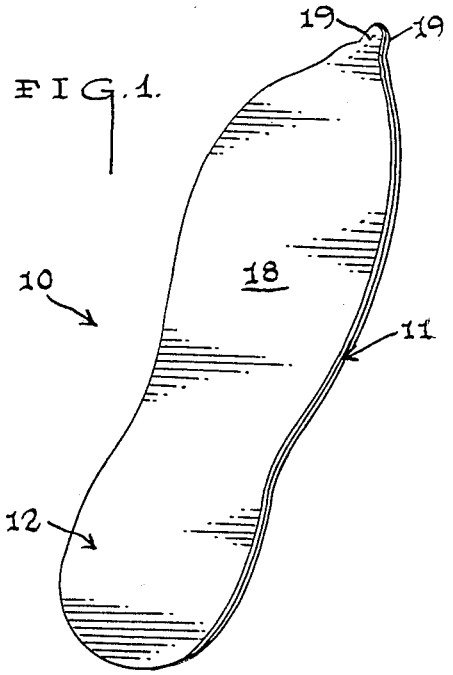
FIG. 2.
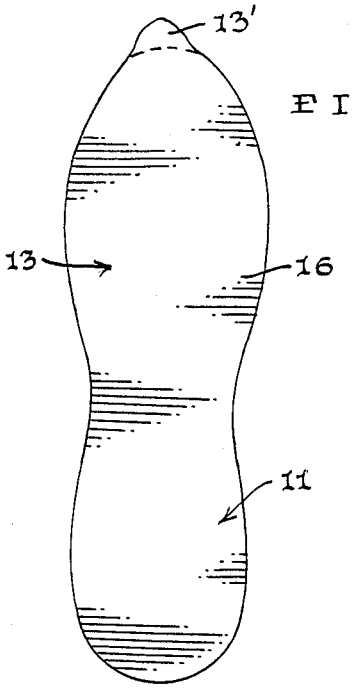
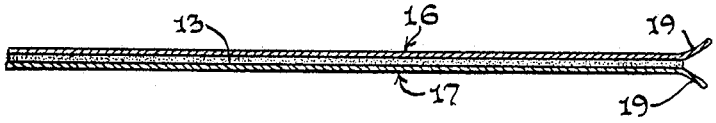
FIG. 3.
FIG. 4.
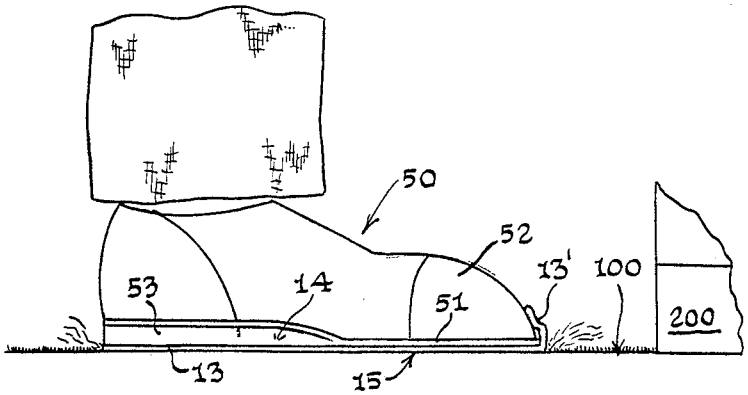

DOUBLE-SIDED ADHESIVE CLEANING APPARATUS

TECHNICAL FIELD

This invention relates in general to disposable cleaning devices, and in particular, to a disposable double-sided adhesive cleaning apparatus designed to cooperate with the sole of a shoe.

BACKGROUND OF THE INVENTION

As can be seen by reference to the following U.S. Pat. Nos.: 3,906,578; 3,417,418; 3,389,416; and 3,231,981 the prior art is replete with myriad and diverse adhesive coated cleaning devices.

While the prior art constructions are more than adequate for the purpose and function for which they were specifically designed, they do suffer from a number o shared deficiencies.

For instance, all of the prior art cleaning devices are designed for the removal of lint from clothes, and as a consequence they generally comprise hand held configurations of one sort or another. Given the limitation that these devices must be hand held in their operative mode of disposition, severely restricts the utilitarian usage of this type of a device for cleaning articles other than clothes.

Also considering the fact that most vacuum cleaners cannot reach into corners or along the edges of walls; it comes as somewhat of a surprise that to date no one has developed an adhesive based cleaning apparatus that would be adapted to reach into these hard to reach areas; and, which would also not require the user to bend over to manually manipulate the cleaning apparatus over great distances.

Obviously, there has been a longstanding need for a double-sided adhesive cleaning apparatus which is designed for deployment in a location other than in or on the hand, and which also incorporated features for cleaning something other than clothes. The development of such a device is the stated purpose and objective of the present invention.

BRIEF SUMMARY OF THE INVENTION

The cleaning construction that forms the basis of the present invention comprises in general: a double-sided adhesive strip unit. the adhesive strip unit comprises in general: an elongated adhesive strip member having a coating of adhesive material on both sides of the strip member; and, a tap element formed on one end of the strip.

In general, the adhesive strip member is shaped to cooperate with and cover at least a substantial portion of the sole of a shoe; wherein, the tab element projects from the front of the strip member and is adapted to contact the upper portion of the users shoe; such that the main body of the strip member will be maintained in its operative disposition relative to the sole of the users shoe.

Briefly stated, the aforementioned arrangement allows a user to attach the cleaning device to the sole of one or both of their shoes so that the user may simply walk into a room and pick up foreign matter that may accumulate on and along the edges of a carpet or floored surface. After the adhesive surface of the bottom of the strip member has accumulated a certain amount of debris and dirt, removal of the strip is achieved by pulling on the tab member.

BRIEF DESCRIPTION OF THE DRAWINGS

These and other objects, advantages, and novel features of the invention will become apparent from the detailed description of the best mode for carrying out the preferred embodiment of this invention which follows, particularly when considered in conjunction with the accompanying drawings, wherein:

FIG. 1 is a perspective view of the double-sided cleaning apparatus of the present invention;

FIG. 2 is a top plan view of the apparatus;

FIG. 3 is a side plan view of the apparatus; and,

FIG. 4 is a side view of the apparatus deployed on a users shoe.

BEST MODE FOR CARRYING OUT THE INVENTION

As can be seen by reference to the drawings, and in particular to FIG. 1, the double-sided adhesive cleaning apparatus of this invention is designated generally by the reference numeral (10). The cleaning apparatus (10) comprises in general: a double-sided adhesive strip unit (11), and a cover unit (12). These units will now be described in seriatim fashion.

As can be seen by reference to FIG. 2, the adhesive strip unit (11) comprises in general: an elongated adhesive strip member (13) having both upper (14) and lower (15) adhesive coated surfaces; wherein, the adhesive strip member (13) is configured to conform to at least a substantial portion of the sole (51) of a users shoe (50).

In addition, the forward end of the adhesive strip member (13) is provided with an outwardly projecting lip portion (13'), whose purpose and function will be described in greater detail further on in the specification.

Referring now to FIG. 3, it can be seen that the cover unit (12) comprises an upper cover member (16) and a lower cover member (17); wherein, each cover member (16)(17) comprises a contoured protective cover element (18) dimensioned to overlie the upper (14) and lower (15) adhesive surfaces of the adhesive strip member (13). In addition, each of the protective cover elements (18) comprises a slip sheet that is releasably secured to the adhesive coated surfaces (14)(15) of the adhesive strip member (13), to maintain the adhesive coated surfaces (14)(15) in a substantially pristine condition, until such time as the cleaning apparatus (10) is required for use.

As can further be seen by reference to FIGS. 1 and 3, the cover members (16)(17) are dimensioned not only to overlie the upper (14) and lower (15) adhesive surfaces of the adhesive strip member (13); but each of the cover members (16)(17) is provided with a tab element (19) which projects beyond one end of the adhesive strip member (13); whereby the tab elements (19) may be grasped by the user to strip the cover members (16)(17) from their protective engagement with the upper (14) and lower (15) adhesive surfaces of the adhesive strip member (13).

In the intended mode of operation of the cleaning apparatus (10) the upper cover member (16) would be peeled from the upper adhesive surface (14) of the adhesive strip member (13), such that the main body of the upper adhesive surface (14) could be engaged wit the sole (51) of a users shoe (50); wherein, the outwardly projecting lip portion (13') of the strip member (13) would be wrapped over at least a portion of the toe (52) of the users shoe.

At this juncture, the lower cover member (17) would be peeled from the lower adhesive surface (15) of the adhesive strip member (13), such that as the user walked across the surface of a floor (100) the lower adhesive surface (15) would pick up debris from the floor (100) particularly in areas that cannot be reached by a conventional vacuum cleaner (not shown).

It should also be noted that the lip portion (13') of the adhesive strip member (13) by virtue of its attachment to the toe portion (52) of the users shoe (50), will tend to prevent the adhesive strip member (13) from becoming detached from the sole (51) and heel (53) of the users shoe (50), since in the absence of the lip portion (13') there would be a tendency of the adhesive strip member (13) to roll rearwardly relative to the sole (51) of the shoe (50) with the sliding scuffing action needed to collect debris on the floor surface (100) adjacent the edge of walls (200) or the like.

Having thereby described the subject matter of this invention it should be obvious that many substitutions, modifications, and variations of the cleaning apparatus (10) would be possible in light of the above teachings. It is therefore to be understood that the invention as taught and described herein is only to be limited to the extent of the breadth and scope of the appended claims.

I claim:

1. A double-sided adhesive cleaning apparatus to be worn on a shoe having a sole and toe portion for picking up debris from a floor surface; wherein, the double-sided adhesive cleaning apparatus comprises:

an elongated adhesive strip member configured to conform to at least a portion of the sole of a user's shoe; wherein, the elongated adhesive strip member includes upper and lower adhesive coated surfaces.

2. The apparatus as in claim 1 wherein said elongated adhesive strip member is further provided with an outwardly projecting lip portion that is adapted to engage the top portion of the toe of the user's shoe.

3. The apparatus as in claim 2 further comprising:

an upper and a lower cover member wherein each cover member comprises a contoured protective cover element dimensioned to overlie one of the adhesive coated surfaces of said elongated adhesive strip member.

4. The apparatus as in claim 3 wherein each of said cover elements is provided with a tab element to facilitate the disengagement of the cover member from the respective adhesive surfaces of said elongated adhesive strip member.

* * * * *